US009766641B2

(12) United States Patent
Carlen et al.

(10) Patent No.: US 9,766,641 B2
(45) Date of Patent: Sep. 19, 2017

(54) ON-LOAD TAP CHANGER FOR DRY TRANSFORMERS AND DRY TRANSFORMER

(71) Applicant: ABB SCHWEIZ AG, Baden (CH)

(72) Inventors: Martin Carlen, Niederrohrdorf (CH); Jens Tepper, Brilon (DE); Benjamin Weber, Winterberg (DE)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 14/808,056

(22) Filed: Jul. 24, 2015

(65) Prior Publication Data

US 2016/0033980 A1 Feb. 4, 2016

(30) Foreign Application Priority Data

Aug. 1, 2014 (EP) ..... 14 002 701

(51) Int. Cl.

| | |
|---|---|
| ***H01F 21/12*** | (2006.01) |
| ***H01F 21/00*** | (2006.01) |
| ***H01F 29/04*** | (2006.01) |
| ***G05F 1/14*** | (2006.01) |
| ***H01H 9/00*** | (2006.01) |
| ***H01F 27/28*** | (2006.01) |
| ***H01F 27/29*** | (2006.01) |

(52) U.S. Cl.

CPC ..... *G05F 1/14* (2013.01); *H01F 27/2823* (2013.01); *H01F 27/29* (2013.01); *H01H 9/0016* (2013.01); *H01H 2009/0022* (2013.01)

(58) Field of Classification Search

CPC ..... H01F 27/29; H01F 27/2823; H01F 2027/328; G05F 1/14; H01H 9/0016; H01H 2009/0022

USPC ..... 336/192, 137–150; 323/340

See application file for complete search history.

(56) References Cited

U.S. PATENT DOCUMENTS

| | | | | |
|---|---|---|---|---|
| 3,720,867 A * | 3/1973 | Rathbun | H01F 27/402 | 218/118 |
| 4,232,260 A * | 11/1980 | Lambkin | H01M 10/46 | 320/110 |
| 5,516,992 A * | 5/1996 | Dohnal | H01H 9/0044 | 200/11 TC |
| 6,445,269 B1 * | 9/2002 | Sylvain | H01F 27/327 | 336/69 |

* cited by examiner

*Primary Examiner* — Mangtin Lian

(74) *Attorney, Agent, or Firm* — Leydig, Voit & Mayer, Ltd.

(57) ABSTRACT

An on-load tap-changer for dry transformers, having an electric insulating hollow casing extending around a virtual axis, wherein several electric contact sections are foreseen along a path on the inner surface of the hollow casing, which are electrically joined through the wall of the hollow casing and a selector contact in the inner of the cylinder which is moveable along the path and that's outer end is selectively connectable with one of the contact sections by a respective movement. Respective cables are foreseen to electrically connect the contact sections from the radial outer side of the hollow casing, wherein at least some of the cables have a respective surrounding outer insulation at least at their respective connected end.

12 Claims, 5 Drawing Sheets

ON-LOAD TAP CHANGER FOR DRY TRANSFORMERS AND DRY TRANSFORMER

CROSS-REFERENCE TO RELATED APPLICATIONS

Priority is claimed to European Patent Application No. 14 002 701.2, filed on Aug. 1, 2014, the entire disclosure of which is hereby incorporated by reference herein.

FIELD

The invention is related to an on-load tap-changer for dry transformers.

BACKGROUND

A tap-changer is a selector switch which enables the selective electrical connection of one output with one of several contact sections. An on-load tap-changer has the ability to switch under load current. Typically the contact sections are arranged along a circular path wherein the selector contact is rotatable around a virtual axis in the center of the circular path. But also a selector contact which is moveable in axial direction along axially arranged contact sections is a suitable embodiment of an on-load tap-changer. On-load tap-changers are used to adapt the transmission ratio of a power transformer in distribution networks within certain limits.

In this case taps of the transformer winding are electrically connected with respective contact sections of a tap-changer, wherein a certain voltage difference in between the respective connector sections is present, which might be at around +/−10% of the rated voltage of the transformer over all taps. In case of a circular arrangement the connector sections are typically foreseen on the inner surface of an electric insulating hollow casing. The electrical insulation in between adjacent connector sections has to be foreseen to withstand a respective voltage difference. The highest voltage difference will rise in between first and last tap, which are adjacent due to the circular arrangement.

Oil transformers are known for voltages of 380 kV and higher and for a rated power of some 100 MVA for example. As an oil transformer itself also a tap changer for an oil transformer is flooded with the insulation medium oil, which enables a compacter design due to the reduced required insulation distance in between adjacent connector sections.

Dry transformers avoid the insulation medium oil due to reasons of improved security or easier handling. Dry transformers are typically known for voltages up to 36 kV or 72.5 kV with a rated power of for example some MVA. Due to this—at least in relation—not as high voltage the required insulation distances in between the different selector contacts within the tap-changer are not as high so that the size of a respective oil-free on-load tap-changer is still within acceptable limits. Anyhow, the rated voltage for dry transformers is expected to increase in the future, for example to 110 kV.

Disadvantageously within this state of the art is that the size of an oil-free tap-changer for dry transformers is exceeding an acceptable limit with increase of the rated voltage.

SUMMARY

An aspect of the invention provides an on-load tap-changer for a dry transformer, the tap-changer comprising:

an electric insulating hollow casing extending around a virtual axis, the hollow casing including more than one electric contact sections, provided along a path on an inner surface of the hollow casing, the electric contact sections being electrically joined through a wall of the hollow casing; and a selector contact inside of the casing, the selector contact being is moveable along a path and an outer end of the selector contact being selectively connectable with one of the contact sections by a respective movement, wherein respective cables are configured to electrically connect the contact sections from a radial outer side of the hollow cylinder, and wherein at least some of the cables include a respective surrounding outer insulation at least at a respective connected end of the cable.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
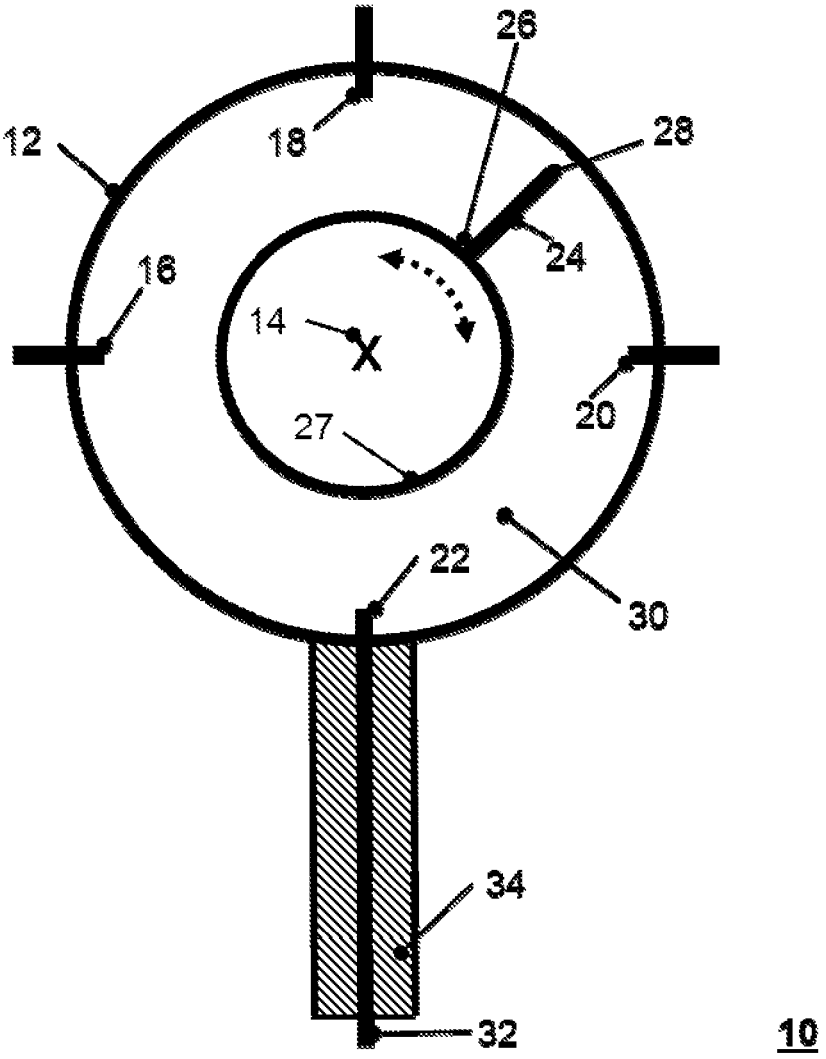
FIG. 1 shows a first exemplary on-load tap-changer.

The invention is related to an on-load tap-changer for dry transformers, comprising an electric insulating hollow casing extending around a virtual axis, wherein several electric contact sections are foreseen along a path on the inner surface of the hollow casing, which are electrically joined through the wall of the hollow cylinder and a selector contact in the inner of the casing which is moveable along the path and that's outer end is selectively connectable with one of the contact sections by a respective movement. The invention is also related to a transformer with an on-load tap-changer.

An aspect of the invention is to provide an on-load tap-changer for dry transformers with a reduced size, especially with respect to an increased rated voltage.

The problem is solved by an on-load tap-changer for dry transformers of the aforementioned kind. This is characterized in that respective cables are foreseen to electrically connect the contact sections from the radial outer side of the hollow casing, wherein at least some of the cables comprise a respective surrounding outer insulation at least at their respective connected end.

Concerning the electrical insulation ability of a tap-changer it has to be distinguished in between insulation within the electric insulating hollow casing and the outer insulation. To successfully reduce the size of a tap changer also the insulation on the outer side of the electric insulating hollow casing has to be foreseen to withstand the increased requirements concerning insulation.

According to the invention a cable is foreseen as electrical conductor leading for example from the taps of a transformer to the connector sections of the tap-changer. The creeping distance in between adjacent cables has significant influence on the insulation ability in between them. A respective surrounding outer insulation at the respective connected end on the tap-changer side of a cable increases the insulation ability in between adjacent cables on the outer side of the tap-changer in an advantageous way. Further increase could be gained by insulation rips or the like.

According to a further embodiment of the invention a front end of the surrounding insulation is hermetically connected with the outer surface of the hollow casing. This might be done for example by use of suitable glue or an epoxy resin. Thus it is excluded in an advantageous way that an air gap in between outer surface of the hollow casing and surrounding insulation is present, which could be reason for an electrical breakthrough. Preferably further means are foreseen, which increase the insulation ability of the tap-changer on its inner side.

According to a further embodiment of the invention the at least one cable comprises at least in sections a screen around its surrounding insulation. Thus the electrical potential on the outer surface of the cable insulation can be set to a defined value by connecting it with a defined voltage potential. Hence the insulation behavior is more reproducible and reliable therewith.

In a further variant of the on-load tap-changer the screen of the cable is electrically connected with one of those contact sections which are not connected with the respective cable. Thus the electrical potential of the screen of the cable is different than the electrical potential of the respective cable itself in case that the tap-changer is in the operating state. This is useful to reduce the potential of the screen compared to the potential of the inner cable, thus the insulation requirements on the outer surface of the hollow casing are reduced due to reduced voltage differences in between the respective screens of the respective cables. A part of the voltage is insulated by the surrounding insulation of the cable in such a case.

According to a further embodiment of the invention the inner space of the hollow casing is hermetically sealed and filled with a pressured insulating gas. Basic idea of this embodiment of the invention is to reduce the size and the insulation distances within the electric insulating hollow casing by sealing it hermetically and filling it with a pressurized insulating gas that's electrical insulation ability is better than the insulation ability of air. Thus the advantages of a dry transformer are still present, wherein the size of the tap-changer is reduced in an advantageous way respectively the tap-changer is enabled to withstand a higher rated voltage.

According to a further embodiment of the invention the insulation gas is SF6. Especially this type of insulation gas is known for insulating switchgear-substations within an energy distribution system and is proven technology.

Following another embodiment of the invention a barrier-shield is foreseen in the radial space in between radial inner and radial outer end of the selector contact, which is rotatable together with the selector contact. Barriers are known means to improve the insulation ability within or around an electrical high voltage device. On the other side a fixed standard barrier is subject to collisions with the rotatable selector contact. Thus the idea of this embodiment consists in making a barrier rotatable together with the selector switch to exclude any collision. Of course, a rotatable barrier-shield is also suitable for a tap-changer, which is not hermetically sealed and which is not filled with a pressured insulating gas.

According to a further embodiment of the invention at least one rip-like barrier is foreseen on the outer surface of the electric insulating hollow casing which is arranged in between respective contact sections which are which are electrically joined through the wall of the hollow casing. The creeping distance in between neighbored contact sections on the outer side are increased in an advantageous way therewith.

An aspect of the invention provides a dry transformer, comprising: a winding with a first, a last and at least one medium tap; and an on-load tap-changer as described before, wherein the respective taps of the winding are electrically connected with respective contact sections of the tap-changer, and wherein the screen of the cable for the first and/or last tap is electrically connected to one of the at least one medium taps.

The first tab is assumed to have the lowest output voltage and the last tap to have the highest output voltage. Assuming further a sequential and circular arrangement of the contact sections within the hollow casing, the contact sections for first and last tap will be adjacent each to each other and the insulation in between the respective cables will be stressed by the maximum voltage difference in between first and last tap. Since the at least one medium tap will have a voltage-level in between the voltage of the first and the last tap, a connection of at least one of the screens of the cables for first or last tab with one of the at least one medium taps will reduce the voltage stress on the outer side of the hollow casing in an advantageous way. In case of several medium taps preferably this tap which is electrically exactly in between the first and last tap should be connected.

FIG. 1 shows a first exemplary on-load tap-changer 10 in a cross-sectional view. An electric insulating hollow casing 12, for example made from glass fiber epoxy, is extending around and along a virtual axis 14. Several exemplary contact sections 16, 18, 20, 22 are arranged along a circular path on the inner surface of the electric insulating hollow casing 12. An inner pole 27 with a radial oriented selector contact 24 with radial inner end 26 and radial outer end 28 is rotatable around the virtual axis 14. By rotation of the inner pole 27 the radial outer end 28 of the selector contact 26 is selectively connectable with one of the contact sections 16, 18, 20, 22.

The contact section 22 is electrically connected with a cable 32 that is surrounded by an outer insulation 34. The insulation 34 increases the insulation ability in between adjacent cables 32 on the outer side of the electric insulating hollow casing 12. The cable 32 is leading to a tap of a non-shown transformer winding and also the other contact sections 16, 18, 20 are supposed to be connected with further taps of the non-shown transformer winding.

By sealing hermetically the inner space 30 of the electric insulating hollow casing 12 and filling it with a pressured gas such as SF6 the insulation ability in between the contact sections 16, 18, 20, 22 in the inner space of the electric insulating hollow casing 12 is increased advantageously.

Figure 2:
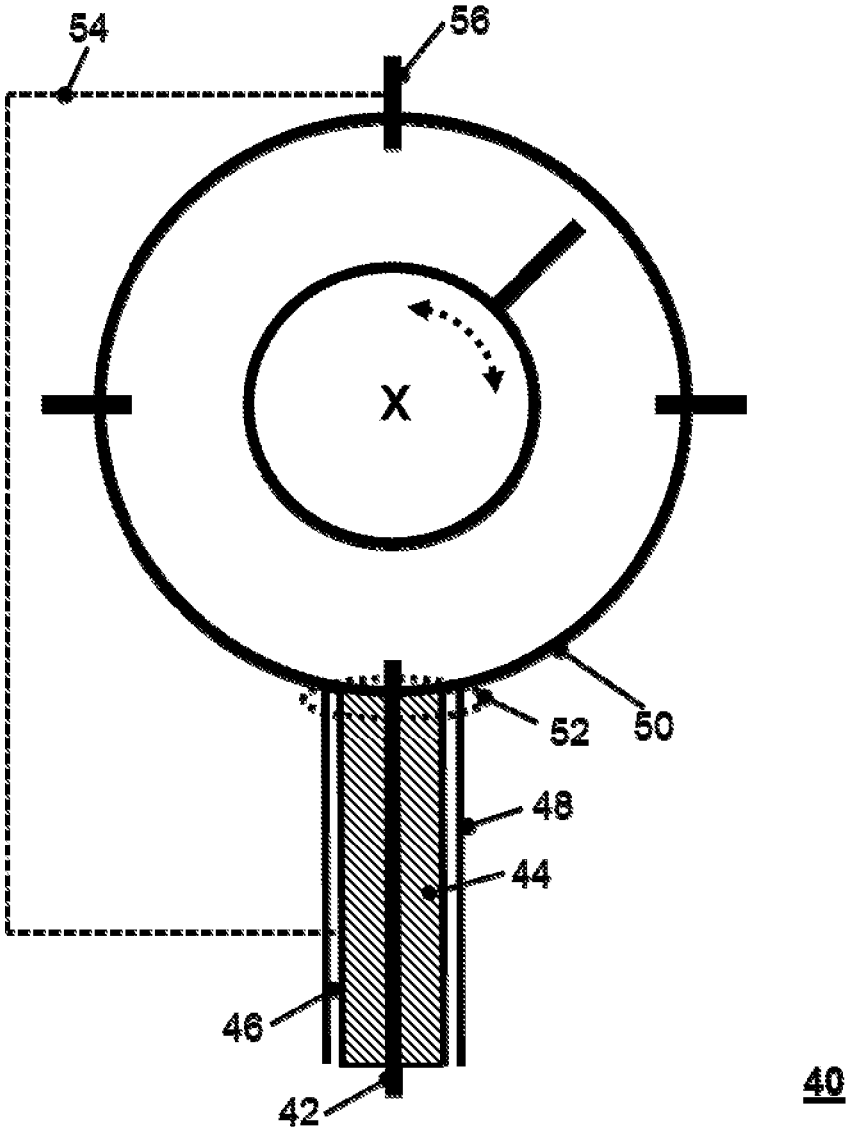
FIG. 2 shows a second exemplary on-load tap-changer.

FIG. 2 shows a second exemplary on-load tap-changer 40 in a cross-sectional view. A cable 42 is leading to the outer surface of an electric insulating hollow casing 50. The cable 42 is surrounded by an outer insulation 44, which itself is surrounded by an electrical screen 46, wherein on the outer surface of the screen 46 a further insulation layer 48 is foreseen. The screen 46 is electrically connected 54 with a further cable leading to another contact section. Thus the electrical potential of the shield corresponds to the potential of the further cable 56. To avoid any air gap in between the axial front end of the surrounding insulation 44 and the electric insulating hollow casing 50 both components 44, 50 are hermetically connected as indicated with the dotted ellipse 52. This can be done for example by use of suitable glue or an epoxy resin or the like.

Figure 3:
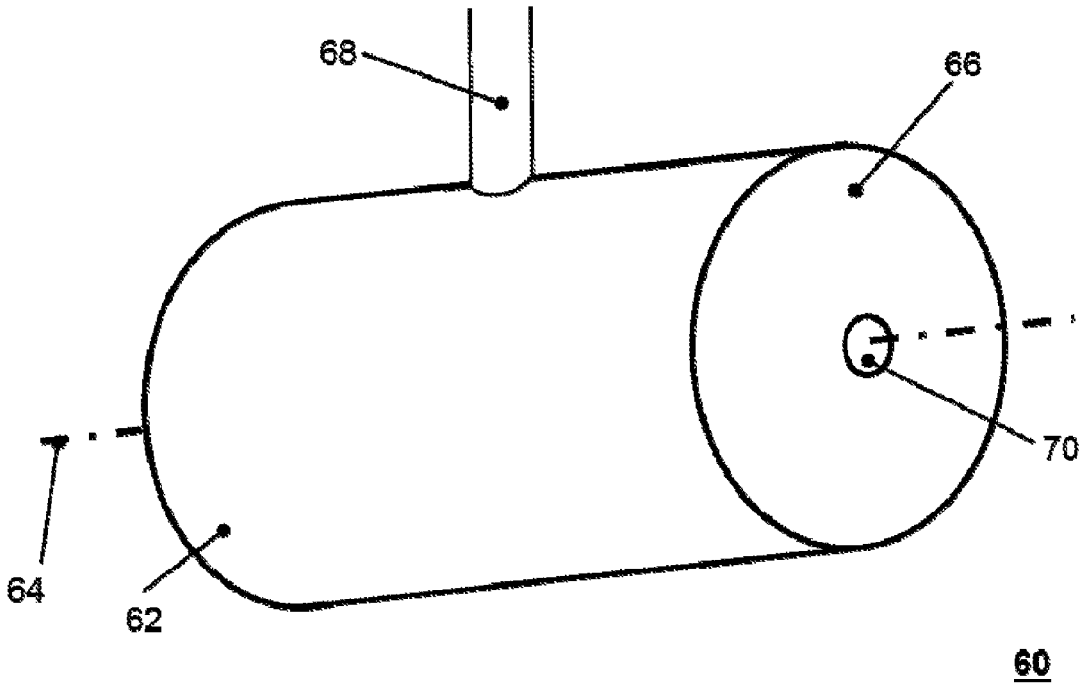
FIG. 3 shows third exemplary on-load tap-changer.

FIG. 3 shows a third exemplary on-load tap-changer 60 in a 3D view. An electric insulating hollow casing 62 is arranged around a virtual axis 64 and shown in a three dimensional view. Front end covers 66 are foreseen at both axial ends to ensure, that the inner space of the electric insulating hollow casing 62 is hermetically sealed, so that pressured insulating gas, which is filled therein, can't leak therefrom. The pressured insulating gas enables a smaller design of the on-load tap-changer 60. A cable 68 indicates an electrical connection to a not shown tap of a transformer, wherein several cables of this kind are supposed to be foreseen. A rotation shaft 70 around the virtual axis 64 is foreseen to rotate a selector contact in the inner of the electric insulating hollow casing.

Figure 4:
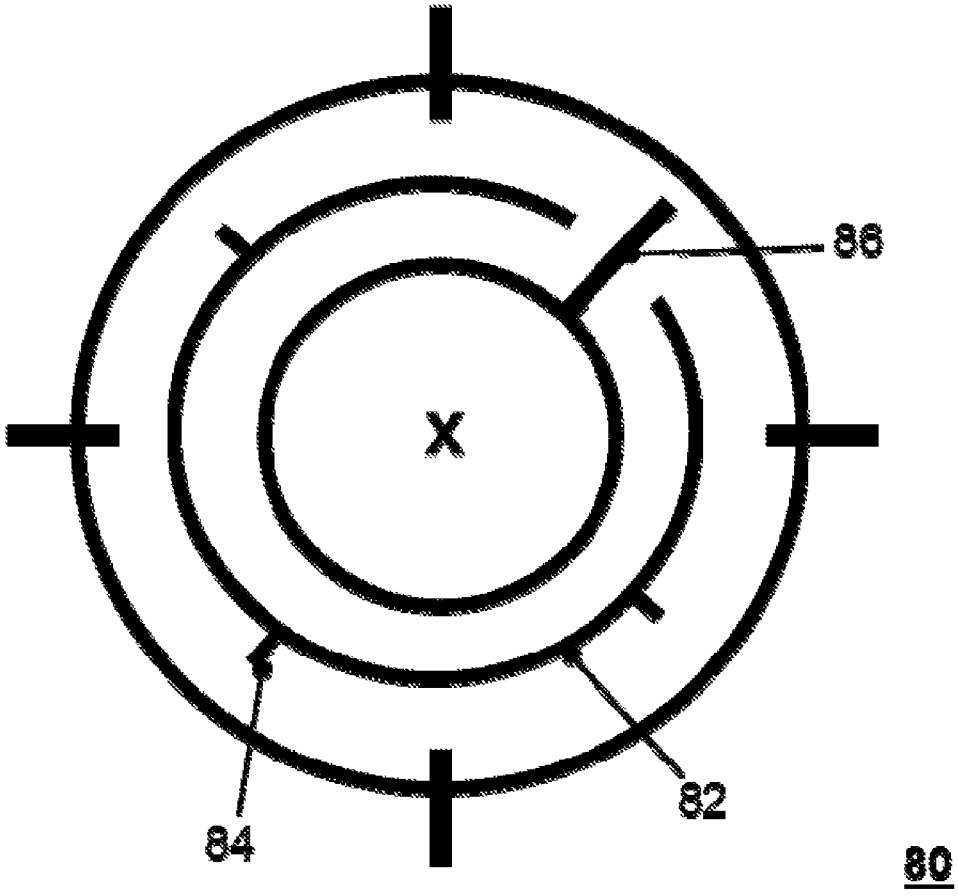
FIG. 4 shows a fourth exemplary on-load tap-changer.

FIG. 4 shows a fourth exemplary on-load tap-changer 80 in a cross-sectional view. Here a selector contact 86 is rotatable together with a barrier shield 82 around a virtual axis, so that the selector contact is selectively connectable with one of several contact sections. Rips 84 increase the creeping distance along the surface of the barrier shield 82. The barrier improves the insulation behavior in the inner of the hollow casing, so that either the tap-changer 80 can be operated with a higher voltage or its size can be reduced in an advantageous way.

Figure 5:
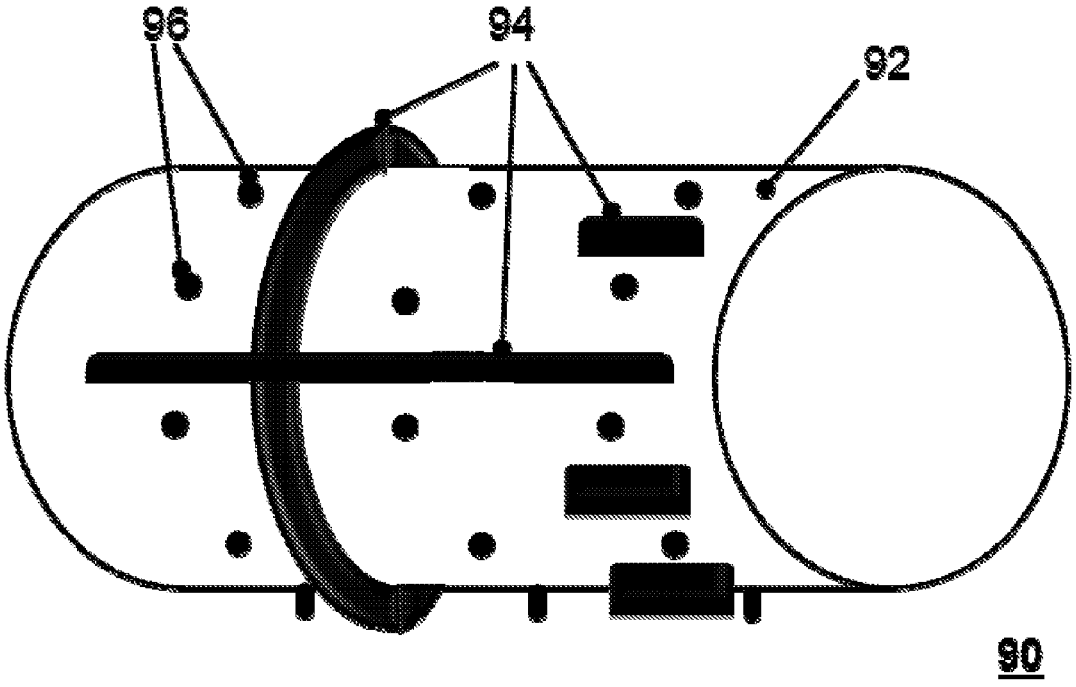
FIG. 5 shows a fifth exemplary on-load tap-changer.

FIG. 5 shows a fifth exemplary on-load tap-changer 90 in a three dimensional view. An electric insulating hollow casing 92, in this case a hollow cylinder, comprises several contact sections 96, which are electrically joined through the wall of the hollow casing 92. The contact sections 96 are distributed in a kind of matrix arrangement, so that as well a rotary as a linear movement of the inner selector contact are suitable to select in between the respective contact sections. Thus the size of the on-load tap-changer 90 can become reduced in an advantageous way. On the outer surface of the electric insulating hollow casing 92 rib-like barriers 94 are foreseen in order to increase the creeping distance in between the contact sections 96.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE SIGNS

10 first exemplary on-load tap-changer
12 electric insulating hollow casing
14 virtual axis
16 first electric contact section
18 second electric contact section
20 third electric contact section
22 fourth electric contact section
24 selector contact
26 radial inner end of selector contact
27 inner pole
28 radial outer end of selector contact
30 inner space of electric insulating hollow casing
32 cable
34 surrounding outer insulation of cable
40 second exemplary on-load tap-changer
42 cable
44 surrounding outer insulation of cable
46 screen
48 further insulation layer
50 electric insulating hollow casing
52 hermetic connection
54 electrical connection
56 further cable
60 third exemplary on-load tap-changer
62 electric insulating hollow casing
64 virtual axis
66 front end cover of casing
68 cable
70 rotation shaft
80 fourth exemplary on-load tap-changer
82 barrier shield
84 rib on barrier shield
86 selector contact
90 fifth exemplary on-load tap-changer
92 electric insulating hollow casing
94 rib-like barriers on outer side of electric insulating hollow casing
96 contact section electrically joined through the wall of the hollow casing

The invention claimed is:

1. An on-load tap-changer for a dry transformer, the tap-changer comprising:

an electric insulating hollow casing disposed around a virtual axis, the hollow casing including more than one electric contact sections, disposed along a path on an inner surface of the hollow casing and being electrically joined through a wall of the hollow casing; and a selector contact disposed inside of the casing, the selector contact being moveable along the path, an outer end of the selector contact being selectively connectable with one of the contact sections by a respective movement, along the path, wherein respective cables are configured to electrically connect the contact sections from a radial outer side of the hollow casing, and wherein at least some of the cables include a respective surrounding outer insulation at least at a respective connected end of the cable.

2. The tap-changer of claim 1, wherein a front end of the surrounding outer insulation is hermetically connected with the outer surface of the hollow casing.

3. The tap-changer of claim 2, wherein at least one cable includes a screen around its surrounding insulation.

4. The tap-changer of claim 3, wherein the screen of the cable is electrically connected with one of the contact sections, which contact section is not connected with the respective cable.

5. The tap-changer of claim 1, wherein an inner space of the hollow casing is hermetically sealed, and wherein an inner space of the hollow casing is filled with a pressured insulating gas.

6. The tap-changer of claim 5, wherein the pressured insulating gas is SF6.

7. The tap-changer of claim 1, further comprising:

a barrier shield in the radial space in between a radial inner and a radial outer end of the selector contact, wherein the barrier shield is rotatable together with the selector contact.

8. The tap-changer of claim 1, further comprising:

a rib-like barrier on an outer surface of the electric insulating hollow casing which is arranged in between respective contact sections.

9. A dry transformer, comprising:

a winding including a first tap, a last tap, and a medium tap; and the tap-changer of claim 3, wherein respective taps of the winding are electrically connected with respective contact sections of the tap-changer, wherein the screen of the cable for the first tap, the last tap, or the first tap and the last tap, is electrically connected to the medium tap.

10. The tap-changer of claim 1, wherein each cable includes a surrounding outer insulation at least at a respective connected end of the cable.

11. The tap-changer of claim 2, wherein each cable includes a screen around its surrounding insulation.

12. The tap-changer of claim 8, wherein the barrier is rib-like.

* * * * *